United States Patent [19]

Bowden, Jr.

[11] Patent Number: 5,006,075

[45] Date of Patent: Apr. 9, 1991

[54] ELECTRICAL RECEPTACLE WITH SHUTTERED PRONG-RECEIVING OPENINGS

[75] Inventor: Wade R. Bowden, Jr., Northport, N.Y.

[73] Assignee: Pass & Seymour, Inc., Syracuse, N.Y.

[21] Appl. No.: 307,910

[22] Filed: Feb. 9, 1989

[51] Int. Cl.[5] ..... H01R 13/44

[52] U.S. Cl. ..... 439/137

[58] Field of Search ..... 439/137–140

[56] References Cited

U.S. PATENT DOCUMENTS

| | | | |
|---|---|---|---|
| 4,544,219 | 10/1985 | Barkas | 439/137 |
| 4,822,290 | 4/1989 | Cauley et al. | 439/137 |
| 4,867,694 | 9/1989 | Short | 439/137 |

*Primary Examiner*—Paula A. Bradley

*Attorney, Agent, or Firm*—Charles S. McGuire

[57] ABSTRACT

An electrical receptacle having openings to receive a plug having either parallel or tandem (perpendicular) blades, and a safety shutter assembly having elements positioned behind the openings to prevent insertion into the electrical contacts of the receptacle of items other than the intended plugs. The shutter assembly includes three individual shutter elements, each positioned upon a spacer element in the back of the receptacle cover for sliding movement thereon. Two of the shutter elements each include a camming portion and a blocking portion, and are positioned for movement by insertion of the blades of a parallel blade plug to permit the blades to be received in the receptacle contacts. The third shutter element is positioned for movement, together with the other two shutter elements, by insertion of a tandem blade plug to permit the blades thereof to be received in the proper contacts. The first two shutter elements are returned to their original positions by springs upon removal of the plug, and the third element is configured and arranged for return movement by one of the spring-biased elements.

17 Claims, 4 Drawing Sheets

ELECTRICAL RECEPTACLE WITH SHUTTERED PRONG-RECEIVING OPENINGS

BACKGROUND OF THE INVENTION

The present invention relates to electrical receptacles of the type having slidable shutter mechanisms arranged behind the openings which receive the blades or prongs of an electrical plug connected to the receptacle. More specifically, the invention relates to receptacles of this type which are adapted to receive either a plug having two parallel prongs, or a plug having tandem or orthagonally disposed prongs.

In order to prevent electrical shocks and possible injuries which could result from insertion of an electrically conducting member into the live terminals of an electrical receptacle, shutter mechanisms have been provided as a safety feature. One type of such shutter mechanism and associated receptacle is shown in U.S. Pat. No. 4,379,607 of the present inventor which is designed to accept a conventional plug of the type having parallel prongs with flat sides lying in substantially parallel planes. Such plugs are generally associated with devices requiring 15 ampere operation, and are thus commonly referred to as 15 amp parallel blade plugs.

Another type of conventional plug has prongs or blades which extend along parallel axes, but which have flat sides arranged in perpendicular (orthogonal, or tandem) planes. These plugs are generally used in connection with 20 ampere operation, thus being commonly termed 20 amp tandem blade plugs. Standard forms of receptacles are provided which will accept both types of plugs, one of the prong-receiving slots being elongated in a first direction and the other slot being T-shaped, having a first portion elongated in a direction parallel to the first slot and a second portion extending at 90 degrees from the mid-point of the first portion, whereby the second portion of the second slot is elongated in a direction perpendicular to the first slot.

A shutter mechanism for a receptacle adapted to receive both of the aforementioned types of plugs is shown in U.S. Pat. No. 4,544,219, issued Oct. 1, 1985, of Barkas. This shutter mechanism includes two slidable shutter members, one of which includes a portion arranged under the T-shaped slot which is divided to form a gap under the portion of the slot which receives the tandem blade. Upon full insertion of such blade, the portions of the shutter member on opposite sides of the gap are forced apart to permit the end of the blade to enter the terminals of the receptacle. Since a relatively small, molded, plastic part must be flexed at two points each time a tandem blade plug is inserted into and withdrawn from the receptacle, and since a misaligned insertion of such a plug may result in a greater amount of flexure than that intended, there is the danger of breakage of the shutter mechanism, requiring replacement of the entire receptacle.

The general object of the present invention is to provide a novel and improved shutter mechanism for an electrical receptacle adapted to receive both parallel and tandem blade plugs.

A more specific object is to provide a shutter mechanism for an electrical receptacle which will receive a tandem blade plug without requiring flexure of any parts of the shutter mechanism.

Other objects will in part be obvious and will in part appear hereinafter.

SUMMARY OF THE INVENTION

The shutter mechanism of the invention, in the disclosed embodiment, is formed as an assembly including a spacer element, designed to nest within a recess in the back of the receptacle cover, and three shutter elements, each positioned upon the spacer for individual, sliding movement in parallel planes. Two of the shutter elements each include a camming portion and a blocking portion, rigidly joined by a spine portion, and arranged in a normal position with the camming portions of one and the blocking portion of the other lying directly under the portions of the receptacle cover slots which receive the blades of a 15 amp parallel blade plug. The third shutter element includes a camming portion arranged in a normal position directly under the perpendicularly extending portion of the T-shaped slot.

The two first-mentioned shutter elements are mounted for reciprocal, sliding movement in the same direction, transverse to the planes of the blades of a parallel-blade plug. The third shutter element is mounted for reciprocal, sliding movement in a direction perpendicular to the first two shutter elements, each of which is biased by a separate coil spring to the aforementioned normal position. The third shutter element, although not spring biased, cannot be moved away from its normal position until a first of the other two shutter elements is moved away from its normal position due to the presence of a stop portion on the first shutter element. This stop portion is normally positioned in contact with a surface of the third shutter element, blocking movement thereof until the stop portion is moved into registration with a recess in the surface, permitting sliding movement of the third shutter element.

Movement of the third shutter element away from its normal position uncovers a slot in the surface of the spacer element upon which the shutter element is slidable, permitting movement of the tandem plug blade through this slot and into the receptacle terminals. The recess in the third shutter element which moves into the stop portion is angled on one side so that movement of the spring-biased shutter elements back to their normal positions, also moves the third shutter element back to its normal position.

The foregoing and other features of construction and operation of the invention will be more readily understood and fully appreciated from the following detailed description, taken in connection with the accompanying drawings.

DETAIL DESCRIPTION

Figure 1:
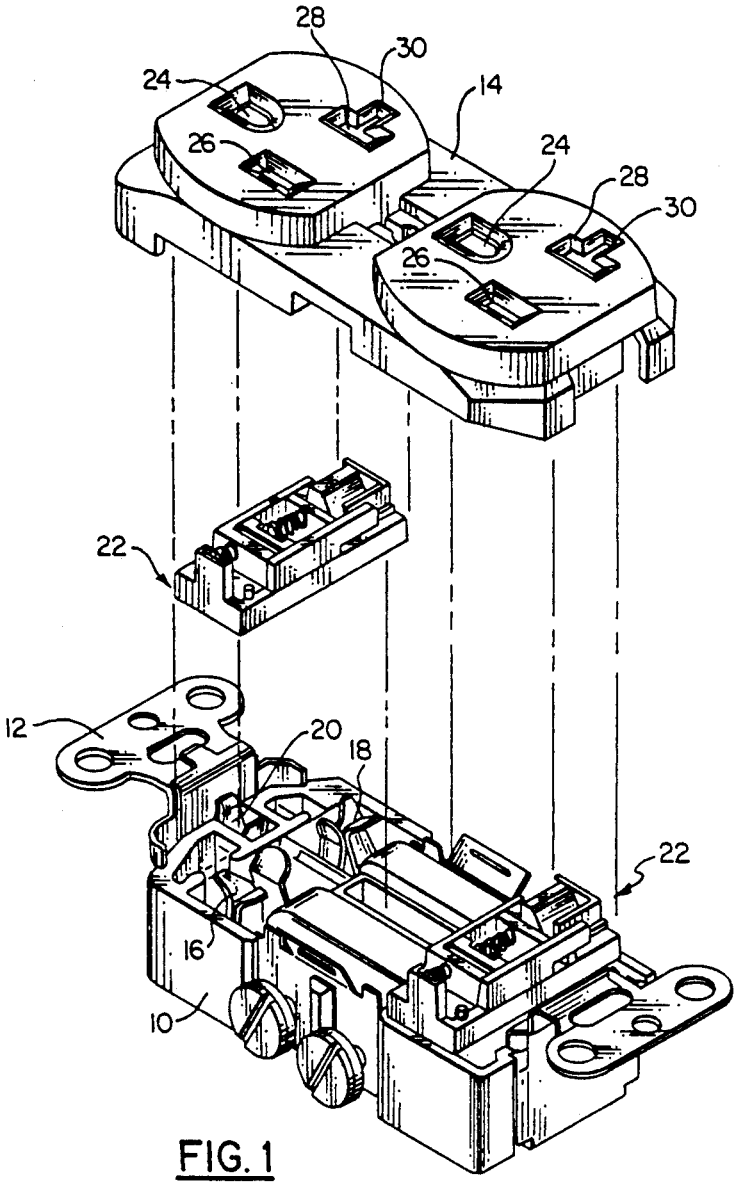
FIG. 1 is a partially exploded, perspective view of an electrical receptacle incorporating the safety shutter assembly of the invention.

Referring now to the drawings, in FIG. 1 is shown a duplex electrical receptacle including the usual base 10, surrounded by mounting strap 12, and normally held in assembled relation with cover 14 to enclose terminals 16, 18 and 20 (and a like set of terminals, not seen, at the other end), and a pair of shutter assemblies indicated generally by reference numeral 22. Cover 14 includes two sets of openings for receiving the blades of plugs connected to the receptacle. One opening 24 of each set receives the grounding blade, which inserts in terminals 20 in the usual manner a feature of the receptacle with which the present invention is not concerned.

One of the other openings 26 of each set is in the form of a slot enlongated in a direction parallel to the longitudinal axis of the receptacle, while the remaining openings include a first portion 28 parallel to opening 26 and a second portion 30 extending from the midpoint of first portion 28 along an axis perpendicular thereto. Plug blades inserted through openings 26 are received in terminals 16, after passing through portions of shutter assembly 22 in a manner described later. If the plug is of the parallel blade type, the remaining blade passes through first portion 28 of the other opening; if it is of the tandem blade type, the blade passes through second portion 30, with an edge portion extending into the central part of first portion 28. In either case, the remaining blades are received in portions of terminals 18, after passing through portions of the associated shutter assembly 22.

Figure 2:
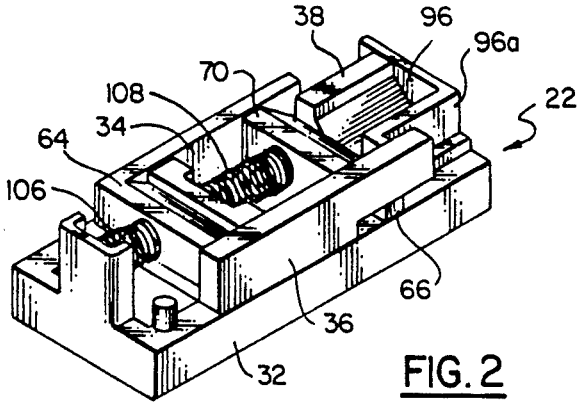
FIG. 2 is a perspective view of the shutter assembly.
Figure 3:
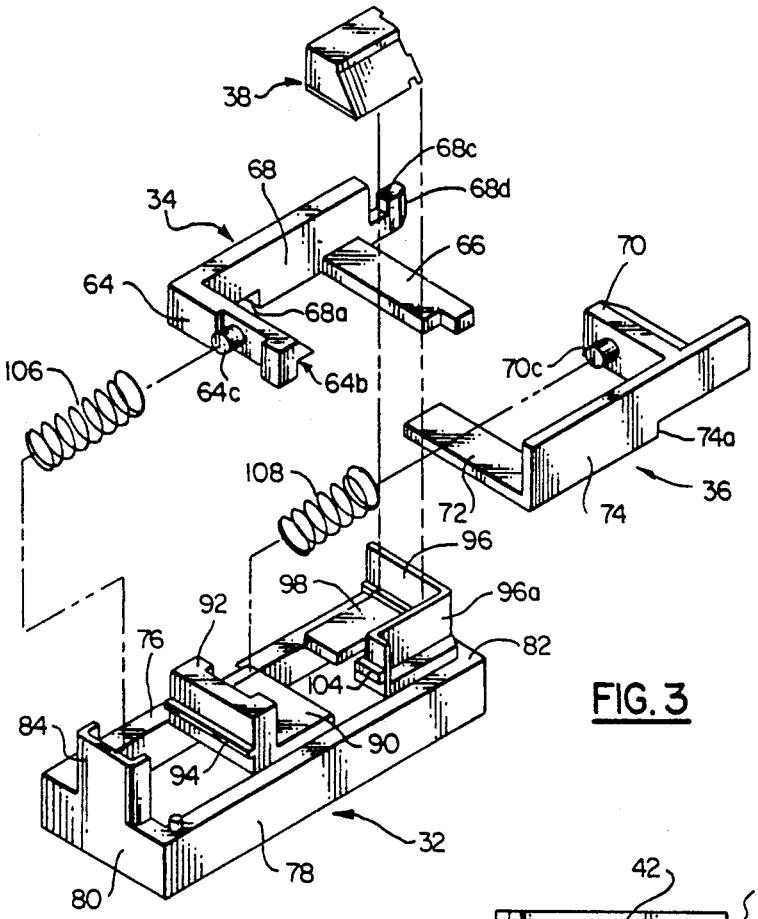
FIG. 3 is an exploded perspective view of the elements of the shutter assembly.
Figure 4A:
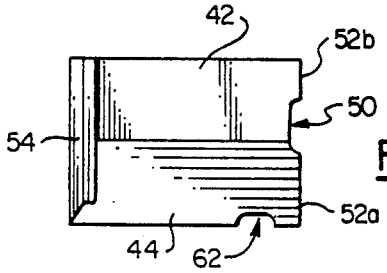
FIGS. 4*a*–4*f* are top, front, bottom, right side, rear, and left side views, respectively, of one of the shutter elements.
Figure 4B:
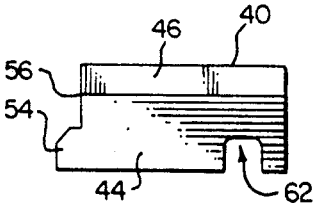
Figure 4C:
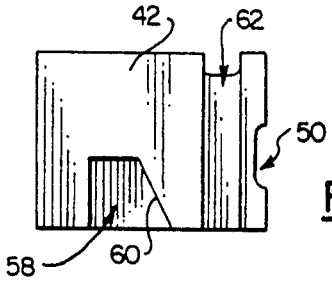
Figure 4D:
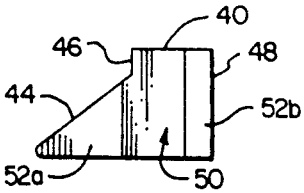
Figure 4E:
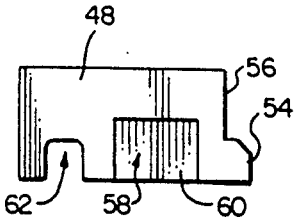
Figure 4F:
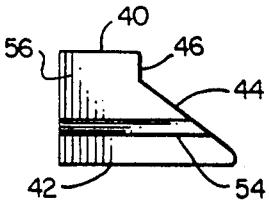
Figure 5B:
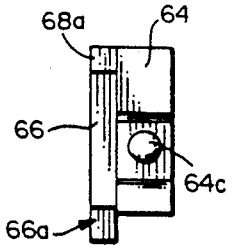
FIGS. 5*a*–5*f* are top, front, rear, bottom, right and left side views, respectively, of another of the shutter elements.
Figure 5A:
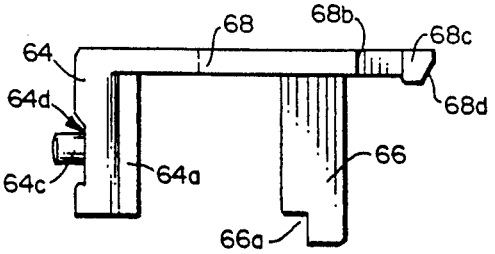
Figure 5C:
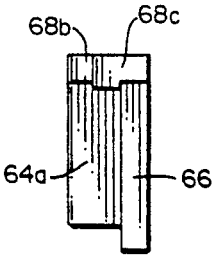
Figure 5D:
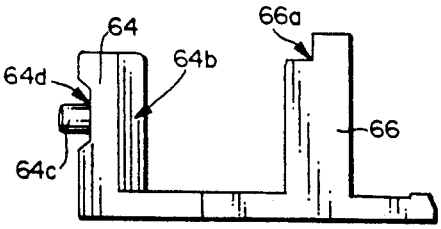
Figure 5E:
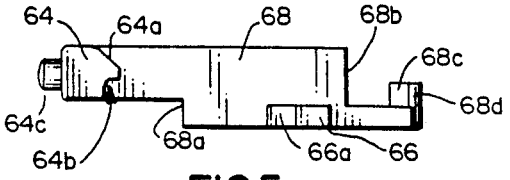
Figure 5F:
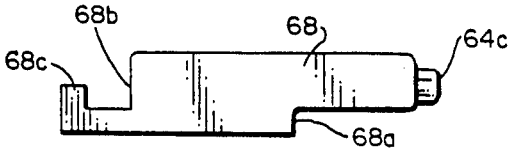
Figure 6B:
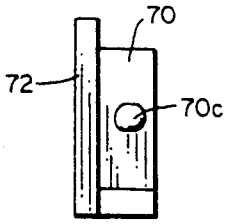
FIGS. 6*a*–6*f* are top, front, rear, bottom, right and left side views, respectively, of another of the shutter elements.
Figure 6A:
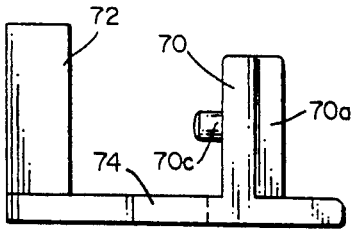
Figure 6C:
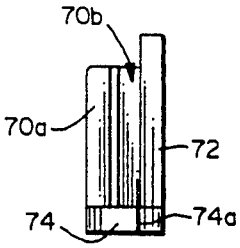
Figure 6D:
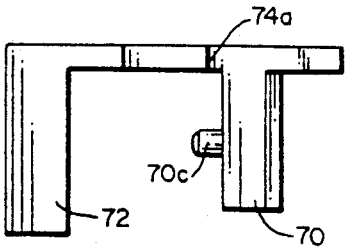
Figure 6E:
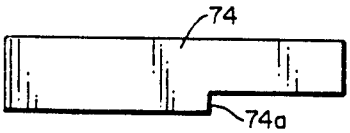
Figure 6F:
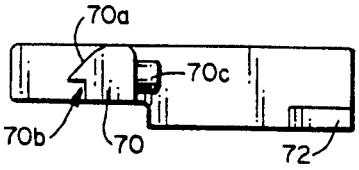

Turning now to FIGS. 2 and 3, one of shutter assemblies 22 (which are identical in construction and operation) is shown in the fully assembled condition and in exploded perspective, respectively. Assembly 22 includes a support frame, termed a spacer element 32, and first, second and third shutter elements 34, 36 and 38, respectively. Shutter elements 34, 36 and 38 are shown individually in detail in FIGS. 5a–5f, 6a–6f and 4a–4f, respectively, and spacer element 32 is shown in detail in FIGS. 7a–7f. These elements will be individually described prior to explaining the manner of their cooperative assembly and operation.

Referring first to FIGS. 4a–4f, third shutter element 38 is seen to include parallel, planar, upper and lower surfaces 40 and 42, respectively. Forwardly disposed camming surface 44 is angularly disposed with respect to surfaces 40 and 42, having an upper edge which is spaced downwardly from upper surface 40 by vertical surface 46, for a purpose described later. Rear surface 48 is planar and perpendicular to upper and lower surfaces 40 and 42. The right side surface is divided by shallow recess 50 into coplanar portions 52a and 52b. Rail portion 54 extends along the lower part of the left side, from front to rear, below planar surface 56.

Recess 58 extends into rear surface 48, from lower surface 42 upwardly, having angularly disposed inner side surface 60. Recess 62 extends upwardly from lower surface 42 and continuously from front to rear. The purpose and function of these recesses, as will as other parts of element 38, will be explained later with respect to other parts of assembly 22. The preferred angles of camming surface 44 with respect to lower wall 42, and surface 60 with respect to rear wall 48, are about 35° and 65°, respectively.

As seen in FIGS. 5a–5f, first shutter element 34 includes a camming member 64 and a blocking member 66 extending in spaced, generally parallel relation from side member 68. Camming member 64 includes an angularly disposed camming surface 64a which is positioned directly beneath opening 26 in the assembled condition of the receptacle and the normal position of the shutter elements. Under the same conditions, blocking member 66 is positioned directly beneath portion 28 of the T-shaped opening. One corner of blocking member 66 is notched, as indicated at 66a. Camming member 64 is undercut along the full width of its lower side, beneath the lower edge of camming surface 64a, as indicated at 64b.

Side member 68 is notched along its lower and upper sides to provide shoulders 68a and 68b, respectively. Projection 68c extends upwardly from the terminal end of side member 68, in spaced relation to shoulder 68b. Stub shaft 64c extends forwardly from camming member 64 within recess 64d.

Shutter element 36, shown in FIGS. 6a–6f, includes camming member 70, blocking member 72 and side member 74. Camming surface 70a is angularly disposed on the side of camming member 70 opposite blocking member 72. Camming member 70 is undercut along the full width of its lower side, beneath the lower edge of camming surface 70a, as indicated at 70b. Stub shaft 70c projects forwardly from the front surface of camming member 70. Side member 72 is notched along its lower surface to provide shoulder 74a. In the fully assembled condition of the receptacle and the normal positions of the shutter elements, camming surface 70a is positioned directly under first portion 28 of the T-shaped slots, and above blocking member 66 of shutter element 34; blocking member 72 is positioned directly beneath camming member 64 of shutter member 34 and thus beneath opening 26.

Turning now to FIGS. 7a–7f, spacer member 32 is seen to include side walls 76 and 78, and end walls 80 and 82. Recess 76a is formed in side wall 76, extending across the full height of the outer surface thereof. Generally U-shaped wall portion 84 extends upwardly from a central portion of end wall 80, and stub shaft 86 extends upwardly from the upper surface of side wall 78, near the juncture thereof with end wall 80. Medial wall 88 extends between side walls 76 and 78 for the full height thereof, midway between end walls 80 and 82.

Figure 7A:
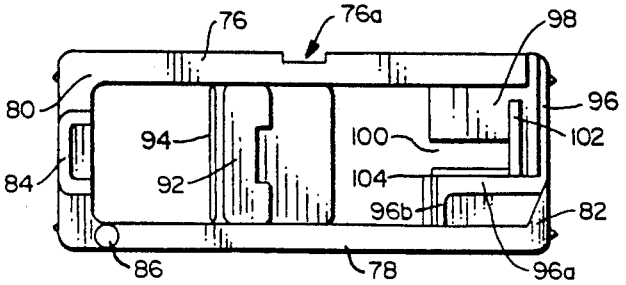
FIGS. 7a–7f are top, bottom, front, rear, right and left side views, respectively, of the spacer element.
Figure 7B:
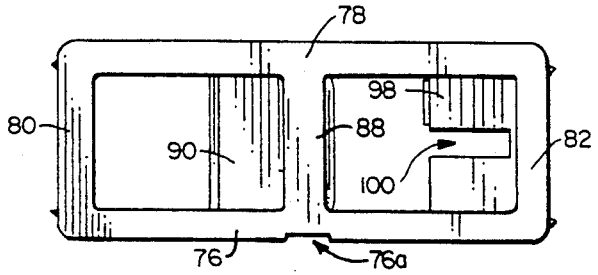
Figure 7D:
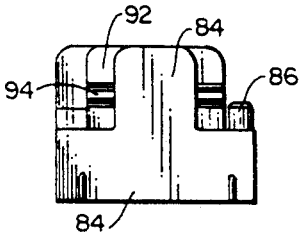
Figure 7C:
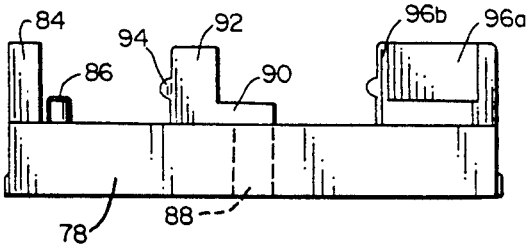
Figure 7E:
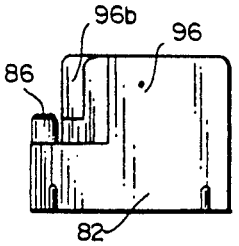
Figure 7F:
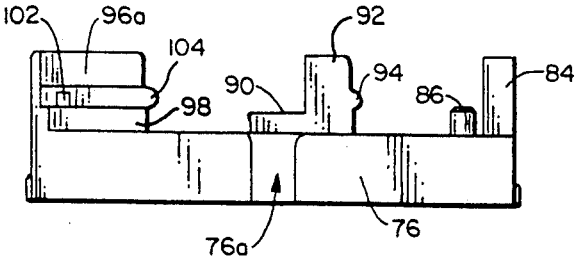

Horizontal wall portion 90 extends laterally between the inner edges of the upper surfaces of side walls 76 and 78, and upwardly from the side walls, being integral at one end of its lower side with the upper side of medial wall 88. Wall portion 92 extends upwardly from wall portion 90, being substantially U-shaped in plan view, as seen in FIG. 7a, in the manner of wall portion 84, although somewhat thicker and wider. Projection 94 extends outwardly, across the forward surface of wall portion 90.

Additional structure adjacent end wall 82 includes an upwardly extending wall portion having laterally extending section 96, forwardly extending section 96a and short, outwardly extending section 96b. Horizontal wall portion 98 has an upper surface in the plane of wall portion 90, includes longitudinal, through slot 100. Guide track 102 extends upwardly from the surface of wall portion 98 and laterally across the rear of slot 100. Protrusion 104 extends outwardly across the forward surface of wall section 96b, as well as across the inner surface of wall section 96a.

The relative positions and cooperative movements of the elements in their operative condition will be more readily understood by referring again to FIGS. 2 and 3. Spacer element 32 is nested within an appropriately shaped recess on the underside of receptacle cover 14 and maintains the shutter elements in their properly spaced positions between the openings in the cover and the terminals in base 10. Shutter elements 34 and 36 are positioned with the lower surfaces of side members 68 and 74 resting upon the upper surfaces of slide walls 76 and 78 of spacer element 32 for reciprocal, sliding movement thereon. Blocking member 66 is positioned under camming member 70 with its terminal end resting on side wall 78 in the cut-out area of side member 74 behind shoulder 74*a*. Blocking member 72 is positioned under camming member 64 with its terminal end resting on side wall 76 in the cut-out area of side member 68, forwardly of shoulder 68*a*.

Shutter element 38 is positioned with its lower surface 42 resting upon the upper surface of wall portion 98 of spacer element 32 for sliding movement in the transverse direction, i.e., parallel to end wall 82. In its normal position, shutter element 38 lies in covering relation to slot 100 which, as previously mentioned, is positioned between second portion 30 of the T-shaped opening in cover 14 and terminals 18. Guide rail 102 is positioned in recess 62 to define the path of movement of shutter element 38.

The shutter elements are biasd to what has been described as their normal positions by coil springs 106 and 108. One end of spring 106 encircles stub shaft 64*c* and is compressed between camming member 64 and the inner surface of wall portion 84 of spacer element 32. Shutter element 34 is thus biased to a position wherein the lower edge of camming surface 64*a* abuts wall portion 92, with protrusion 94 extending into undercut area 64*b* and abutting the camming member beneath the camming surface. Also, the relative dimensions of spacer element 32 and shutter element 34 are such that blocking member 66 abuts the forward edge of wall portion 98 to provide stop means defining the normal position of shutter element 34.

One end of spring 108 encircles stub shaft 70*c* and the other end abuts wall portion 92, thereby biasing shutter element 36 wherein blocking member 72 abuts the forward surface of wall portion 90. In this position, protrusion 54 on shutter element 38 extends into undercut area 70*b* of camming member 70. Thus, shutter element 38 is constrained on opposite sides by wall section 96 and camming member 70 of shutter element 36, on the front by wall section 96*a* and on the rear by side member 68 of shutter element 34.

If a single object, e.g., a screwdriver blade, were to be inserted into opening 26 it would contact camming surface 64*a*. Continued, forceful insertion of the object would cause it to slide down the camming surface, moving shutter element 34 toward wall portion 84 against the biasing force of spring 106. However, since shutter element 36 would not be moved, the object would contact blocking member 72 thereof, preventing its insertion into terminals 16. Likewise, if such an object were inserted into first portion 28 of the T-shaped opening, it could move down camming surface 70*a*, moving shutter element 36 toward wall portion 92 against the bias of spring 108. The object would then contact blocking member 66 of shutter element 34, which would not be moved, and the object could not enter terminals 18. If an object were inserted into second portion 30 of the T-shaped opening, it would contact camming surface 44 of shutter element 38 which cannot move to uncover slot 100 since side member 68 of shutter element 34 blocks its path.

When a parallel blade plug is connected to the receptacle in the intended manner, the blades enter opening 26 and first portion 28 of the T-shaped opening, contacting camming surfaces 64*a* and 70*a* of shutter elements 34 and 36, respectively. Continued insertion of the plug causes the blades to slide down the camming surfaces, moving both shutter elements 34 and 36 simultaneously, whereby both of blocking members 66 and 72 are removed from covering relation with terminals 16 and 18, respectively, permitting electrical communication between the plug blades and receptacle terminals in the desired manner.

When a tandem blade plug is connected to the receptacle, one blade is inserted into opening 26 and the other into second portion 30 of the T-shaped slot. An edge portion of the other blade also extends into the central area of first portion 28, i.e., the area which is common to both the first and second portions of the T-shaped opening. The other blade first contacts camming surface 70*a* of shutter element 36 which is closer to the T-shaped opening than camming surface 44 of shutter element 38 since camming surface 44 is positioned further down element 38 (by the height of surface 46) than camming surface 70*a* which begins at the top of camming member 70 (see, e.g., FIG. 6*f*). Thus, insertion of a tandem blade plug will also move both of shutter elements 34 and 36 simultaneously, as the blades slide down camming surfaces 64*a* and 70*a*.

Movement of shutter element 34 brings projection 68*c* into registration with recess 58 in shutter element 38. This permits movement of shutter element 38 as continued insertion of the other plug blade causes it to slide down camming surface 44. Thus, shutter element 38 is moved to uncover slot 100, permitting insertion of the blade into terminals 18.

When the blades of either type of plug are removed from the receptacle, the shutter elements are returned to their normal positions by the biasing force of springs 106 and 108. As shutter element 34 moves back to its normal position, angled surface 68*d* on projection 68*c* slides on angled surface 60 of recess 58, moving shutter element 38 back to its original or normal position as the springs move the other two shutter elements back to their normal positions.

From the foregoing it may be seen that the invention provides a safety receptacle which may be used with either 15 amp parallel blade plugs or 20 amp tandem blade plugs. The elements of the shutter assembly are cooperatively assembled and operated in a manner providing reliable operation over a viturally unlimited number of cycles without requiring mechanical flexure or stress of any components. Separate shutter elements are provided for limiting access through the first cover opening and through the two, perpendicular portions of the T-shaped opening. The shutter elements are supported for movement upon and maintained in properly spaced relationship with respect to one another and to other receptacle elements by a stationary spacer member. Although the spacer member is described herein as an independent element, it will be understood that it could be incorporated in the base portion of the receptacle as an integral part thereof, if desired.

What is claimed is:

1. In an electrical receptacle of the type having a cover and a base held in a predetermined assembled relationship, said cover having at least one pair of spaced openings, one of which is generally elongated along a first axis and the other of which is T-shaped, having a first portion which is elongated in a direction parallel to said first axis and a second portion extending contiguously from the longitudinal mid-point of the first portion along a second axis, perpendicular to said first axis, and wherein blade-receiving terminals are positioned in said base in alignment with both of said openings to receive the blades of either a parallel blade or tandem blade type of plug which is connected to said receptacle, a safety shutter assembly for preventing an object inserted through only one of said openings from contacting the terminals aligned therewith, said assembly comprising:

(a) a first shutter element including a first, elongated side member, a first camming member having a first camming surface, and a first blocking member, said camming and blocking members extending in the same direction, perpendicularly from said first side member and spaced by a distance substantially equal to the distance between said one opening and said first portion of said other opening;

(b) a second shutter element including a second, elongated side member, a second camming member having a second camming surface, and a second blocking member, said second camming and blocking members extending in the same direction, perpendicularly from said second side member and spaced by a distance substantially equal to the spacing of said first camming and first blocking members;

(c) a third shutter element having a third camming surface;

(d) support means upon which each of said first, second and third shutter elements are supported for independent movement between first and second positions, said shutter elements being so supported and arranged relative to one another and to said cover and base that, when all of said shutter elements are in said first position, said first camming surface is aligned with said one opening and said second blocking member is positioned between said first camming member and the terminals aligned with said first opening, said second camming surface is aligned with said first portion of said T-shaped opening and said first blocking member is positioned between said second camming member and the terminals aligned with said first portion of said T-shaped slot, and said third camming surface is aligned with said second portion of said T-shaped opening and a portion of one of said side members is positioned to block movement of said third shutter element to said second position thereof.

2. The shutter assembly of claim 1 wherein said support means comprises an individual element having a plurality of planar surfaces upon which said first, second and third shutter elements are supported for reciprocal, sliding movement between said first and second positions.

3. The shutter assembly of claim 1 wherein said first and second camming surfaces are in substantially parallel planes, and said third camming surface is in a plane intersecting said parallel planes.

4. The shutter assembly of claim 1 and further including means biasing said first and second shutter elements toward said first positions thereof.

5. The shutter assembly of claim 4 wherein said biasing means comprise a pair of springs respectively arranged between said first and second shutter elements and fixed structure.

6. The shutter assembly of claim 5 wherein said fixed structure comprises portions of said support means.

7. The shutter assembly of claim 4 wherein said third shutter element is moved from its second to its first position in response to movement of said first shutter element from its second to its first position.

8. The shutter assembly of claim 7 wherein said first and third shutter elements move between their respective first and second positions in perpendicular directions.

9. The shutter assembly of claim 8 wherein said first and second shutter elements move between their respective first and second positions in the same direction.

10. The shutter assembly of claim 1 wherein said one of said side members is said first side member, and said portion of said first side member is adjacent one terminal end thereof.

11. The shutter assembly of claim 10 wherein said first camming member extends from said side member at a position adjacent the other terminal end thereof.

12. An electrical receptacle of the type having a safety shutter assembly to prevent insertion of foreign objects into terminals for receiving the blades of a plug connected thereto, said receptacle comprising:

(a) a cover having at least one pair of openings configured to receive either a parallel blade or a tandem blade plug;

(b) a base held in operatively assembled relation with said cover to form an enclosed housing containing electrical terminals aligned with said openings for receiving the blades of either of said plugs;

(c) first, second and third shutter elements having first, second and third camming surfaces, respectively;

(d) an individual spacer element positioned within said enclosed housing supporting each of said shutter elements for independent movement between first and second positions, said first camming surface being positioned in and out of alignment with one of said openings in said first and second positions, respectively, of said first shutter element, said second camming surface being positioned in and out of alignment with a first portion of the other of said openings in said first and second positions, respectively, of said second shutter element, and said third camming surface being positioned in and out of alignment with a second portion of said other opening in said first and second positions, respectively, of said third shutter element;

(e) first blocking means movable between first and second positions in repsonse to movement of said second shutter element between its first and second positions, respectively; and (f) second and third blocking means, each movable between first and second positions in repsonse to movement of said first shutter element between its first and second positions, respectively; and wherein (g) said first blocking means being positioned in and out of alignment with said one opening in said first and second positions, respectively, of said first blocking means, said second blocking means being positioned in and out of alignment with said first portion of said other opening, in said first and second positions, respectively, of said second blocking means, and said third blocking means being positioned in and out of a position blocking movement of said third shutter element from its first to its second position in said first and second positions, respectively, of said third blocking means.

13. The receptacle of claim 12 wherein said spacer element includes a plurality of planar surfaces upon which said first, second and third shutter elements are supported for reciprocal, sliding movement.

14. The receptacle of claim 12 and further comprising first and second springs respectively arranged to bias said first and second shutter elements to said first positions thereof.

15. An electrical receptacle of the type having a safety shutter assembly to prevent insertion of foreign objects into terminals for receiving the blades of a plug connected thereto, said receptacle comprising:

(a) a cover having at least one pair of openings configured to receive either a parallel blade or a tandem blade plug;

(b) a base held in operatively assembled relation with said cover to form an enclosed housing containing electrical terminals aligned with said openings for receiving the blades of either of said plugs;

(c) first, second and third shutter elements having first, second and third camming surfaces, respectively;

(d) support means supporting each of said shutter elements for independent movement between first and second positions, and first camming surface being positioned in and out of alignment with one of said openings in said first and second positions, respectively, of said first shutter element, said second camming surface being positioned in and out of alignment with a first portion of the other of said openings in said first and second positions, respectively, of said second shutter element, and said third camming surface being positioned in and out of alignment with a second portion of said other opening in said first and second positions, respectively, of said third shutter element;

(e) first blocking means movable between first and second positions in response to movement of said second shutter element between its first and second positions, respectively; and (f) second and third blocking means, each movable between first and second positions in response to movement of said first shutter element between its first and second positions, respectively;

(g) said first blocking means being positioned in and out of alignment with said one opening in said first and second positions, respectively, of said first blocking means, and second blocking means being positioned in and out of alignment with said first portion of said other opening, in said first and second positions, respectively, of said second blocking means, and said third blocking means being positioned in and out of a position blocking movement of said third shutter element from its first to its second position in said first and second positions, respectively, of said third blocking means; and wherein (h) said third blocking means comprises a portion of said first shutter element positioned, when said first and third shutter elements are in their first positions, immediately adjacent a surface of said third shutter element in the direction of movement thereof toward said second position thereof.

16. The receptacle of claim 15 wherein said surface of said third shutter element includes a recess, and said portion of said first shutter element is positioned in alignment with said recess when said first shutter element is in its second position, whereby said third shutter element may be moved to its second position with said portion of said first shutter means being received in said recess.

17. The receptacle of claim 16 wherein said first and third shutter elements are movable between their respective first and second positions in perpendicular directions.

* * * * *